US005344148A

United States Patent [19]

Asch

[11] Patent Number: 5,344,148

[45] Date of Patent: Sep. 6, 1994

[54] THREE-DIMENSIONAL PUZZLE

[76] Inventor: Sabine Asch, Heilbronner Strasse 100, 7120 Bietigheim-Bissingen, Fed. Rep. of Germany

[21] Appl. No.: 971,821

[22] Filed: Feb. 17, 1993

[30] Foreign Application Priority Data

Aug. 28, 1990 [DE] Fed. Rep. of Germany ... 9012477[U]

[51] Int. Cl.[5] ..... A63F 9/08

[52] U.S. Cl. ..... 273/156; 273/157 R

[58] Field of Search ..... 273/153 R, 153 P, 155, 273/157 R, 156, 160; 446/124

[56] References Cited

U.S. PATENT DOCUMENTS

| | | | |
|---|---|---|---|
| 2,241,490 | 3/1939 | Steinhardt | 273/160 |
| 3,222,072 | 12/1965 | Dreyer | 273/155 |
| 3,596,396 | 8/1971 | Thomson | 273/155 |
| 3,949,994 | 4/1976 | Knarr | 273/160 |
| 4,219,958 | 9/1980 | Shulyak | 273/155 |
| 4,790,759 | 12/1988 | Mosseri et al. | 273/157 R |
| 5,108,100 | 4/1992 | Essebaggers et al. | 273/157 R |
| 5,110,130 | 5/1992 | Aulicino | 273/155 |
| 5,169,149 | 12/1992 | Pepa | 273/155 |

OTHER PUBLICATIONS

International Preliminary Examination Reported dated Dec. 11, 1992.

*Primary Examiner*—V. Millin
*Assistant Examiner*—Steven B. Wong
*Attorney, Agent, or Firm*—Evenson, McKeown, Edwards & Lenahan

[57] ABSTRACT

A three-dimensional puzzle consisting of puzzle bodies which hang in one another and can be assembled to form a polyhedron body. The puzzle bodies, which hang in one another, form a link chain consisting of a straight number of chain links. One half of the chain links are cornered rings of which, in the assembled condition, at least one outer side forms a portion of the surface of the polyhedron. The other half of the chain links consists of segments of the polyhedron parts which are disposed above one another and which are disposed above and below the plane formed by the rings. These two segments themselves form irregular polyhedrons, are rigidly connected with one another by means of two webs so that they form a closed chain link which, together with the rings, form a link chain which then may be assembled to form, for example, a tetrahedron, a cube, an octahedron or the like.

12 Claims, 4 Drawing Sheets

FIG. 1
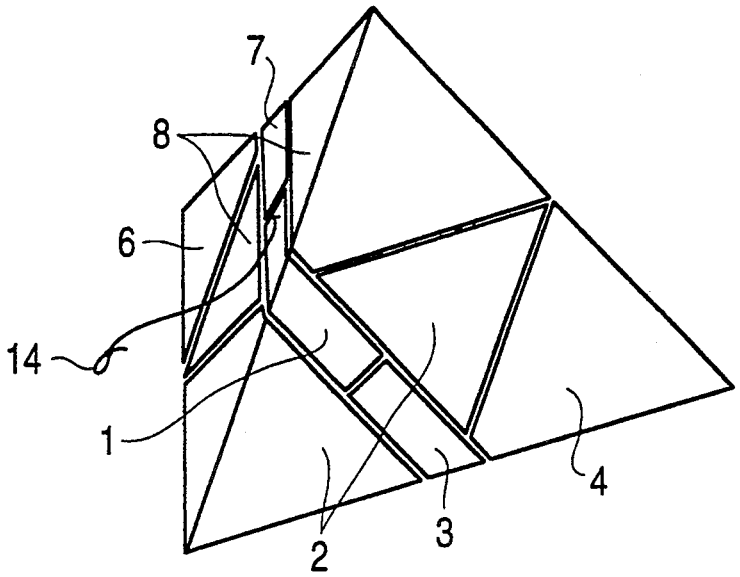
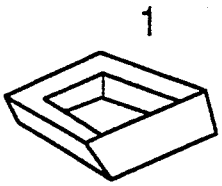
FIG. 2a
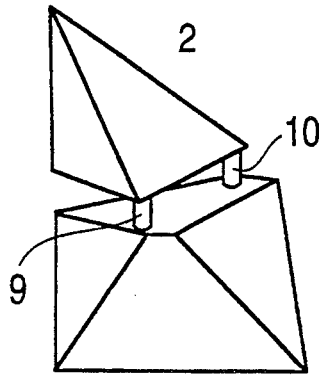
FIG. 2b
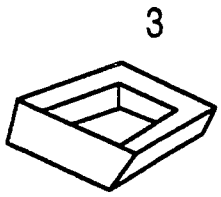
FIG. 2c
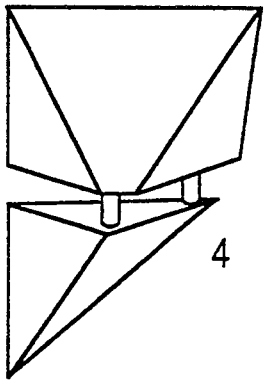
FIG. 2d

THREE-DIMENSIONAL PUZZLE

BACKGROUND AND SUMMARY OF THE INVENTION

The invention is a three-dimensional puzzle game for adults and children.

The main game value of known puzzles is the achieving of the more or less tricky task of creating an order out of disorder. The disassembling or mixing-up does not have any special appeal. This has the disadvantage that the interest in the puzzle will wane as soon as it is determined how it can be assembled correctly and can be solved.

The tetrahedron puzzles which are known from U.S. Pat. No. 3,565,442 as well as the tetrahedron puzzle which is known from German Design Patent G 88 08 167.2 also have this disadvantage. In the case of the latter, this disadvantage is compensated by the fact that it can also be used for various purposes that are not game-related.

Another disadvantage of the known puzzles consists of the fact that, even when they have a regular design, not much attention is paid to the geometrical principles on which the puzzles are based because the "pile of rubble" of the individual pieces stimulates thoughts on how the destroyed whole can be restored and not on according to which principle the individual pieces were shaped.

In addition, familiarity alone is a disadvantage in the case of puzzle games, and consequently there is always a demand for novel puzzles.

It is an object of the invention to provide a three-dimensional puzzle game which is surprising with respect to its unfamiliar pattern and creates particular interest. The puzzle should be entertaining not only when it is put together but also when it is taken apart. For this purpose, a special possibility of a chain link formation is to be indicated which impressively illustrates the existence of generally unexpected bisectional plane shapes of several regular polyhedrons.

The puzzle game is a link chain consisting of an even number of elements .which are hung into one another and form the chain links. The chain can be placed together to form a specific polyhedron body, such as a tetrahedron, a cube, an octahedron, etc. The assembled polyhedron body is completely closed from the outside, and in its interior has only as much hollow space as is required for the mobility of the chain links.

Other objects, advantages and novel features of the present invention will become apparent from the following detailed description of the invention when considered in conjunction with the accompanying drawings.

The additional characteristics will be explained in the following by means of the drawing.

FIG. 1 is a view of an assembled puzzle on the embodiment of a regular tetrahedron;

FIGS. 2*a*, 2*b*, 2*c* and 2*d* are views of four individual elements of the tetrahedron-shaped puzzle;

FIGS. 3*a*, 3*b* and 3*c* are a rear view, a front view and a side view of a disassembled tetrahedron puzzle chain;

FIG. 4 is a schematic view concerning the principle of the puzzle on the example of a regular tetrahedron;

FIGS. 5*a*, 5*b* and 5*c* are additional schematic drawings concerning the principle of the division of the tetrahedron puzzle into the chain elements;

DETAILED DESCRIPTION OF THE DRAWINGS

Figure 3A:
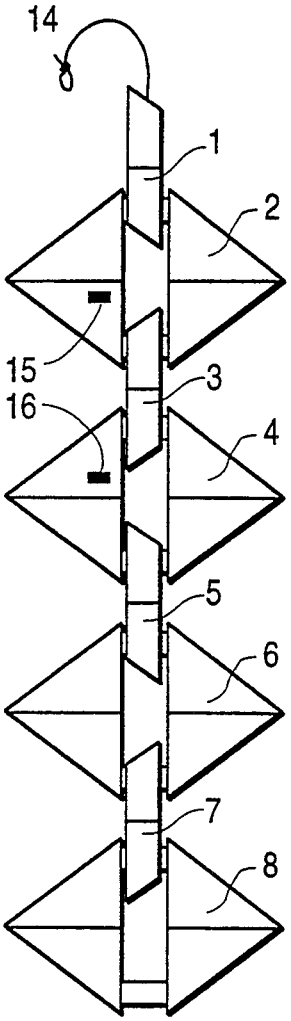

FIG. 1 illustrates an example of an assembled puzzle; it is a regular tetrahedron. In the drawing, two tetrahedron surfaces are visible. On them, surfaces of seven puzzle elements 1, 2, 3, 4, 6, 7 and 8 are visible.

Figure 3B:
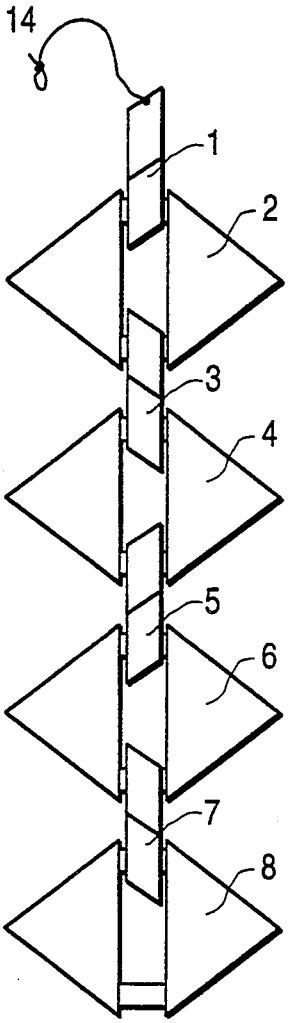
Figure 3C:
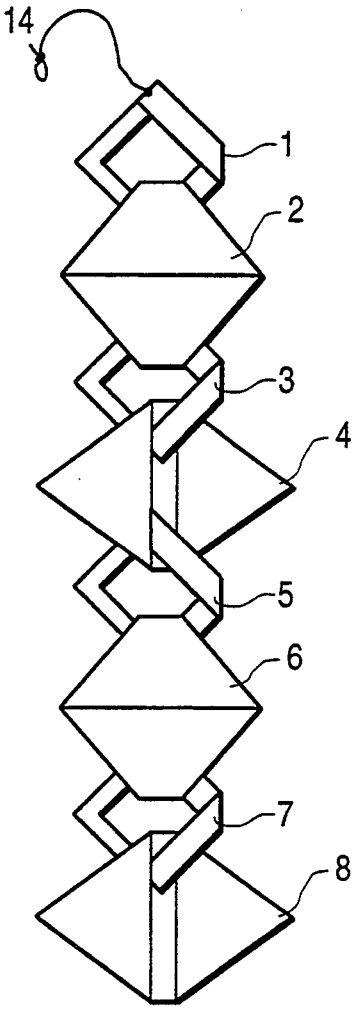

FIGS. 3*a*, 3*b* and 3*c* illustrate a disassembled tetrahedron puzzle. It is an eight-link movable link chain. FIG. 3*a* is a rear view of the chain; FIG. 3*b* is a front view; and FIG. 3*c* is a lateral view. FIGS. 2*a*, 2*b*, 2*c* and 2*d* illustrate the first four chain elements 1, 2, 3 and 4 individually.

In this embodiment, the chain consists of four ring-shaped cornered elements 1, 3, 5 and 7 and four elements 2, 4, 6 and 8 which are each composed of two irregular polyhedrons which are rigidly connected with one another into a closed chain link by means of two webs (9 and 10 in FIG. 2*b*) respectively. Only the last element 8 has only one web. Each web leads through one of the ring-shaped elements so that all elements hang in one another as chain links, the ring-shaped links alternating with the irregular polyhedron pairs.

Two of the ring-shaped elements are identical (1 and 5), and the other two are mirror-inverted (3 and 7) with respect to the former. The polyhedron pairs 2, 4, 6 and 8 are all identical, except that the last element 8 has only one instead of two connecting webs.

For the further explanation of the characteristics of the puzzle, it is expedient to explain the principle according to which a polyhedron is divided so that it results in a puzzle chain. The following description relates to the embodiment of the puzzle as a regular tetrahedron. This applies correspondingly to puzzle designs of other shapes.

Figure 4:
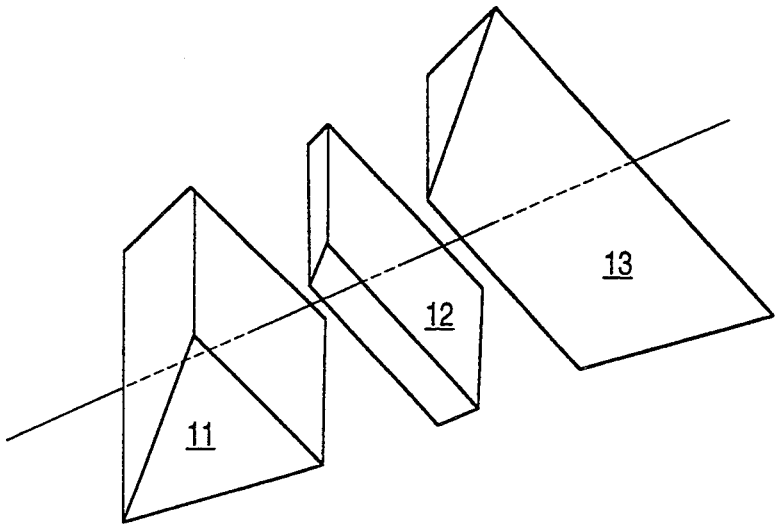

By means of two plane parallel cuts, the tetrahedron is divided into three parts: a rectangular disk which "bisects" the tetrahedron, and the two remaining identical "halves" above and below this disk. The diagrammatic drawing of FIG. 4 shows these parts 11, 12, and 13. The planes of section extend at a right angle with respect to an imaginary center axis of the tetrahedron which is indicated by an interrupted line in FIG. 4.

Figure 5A:
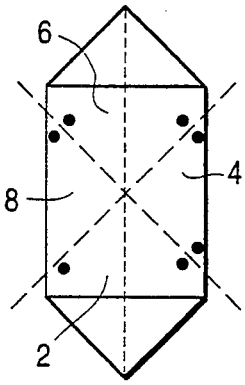
Figure 5B:
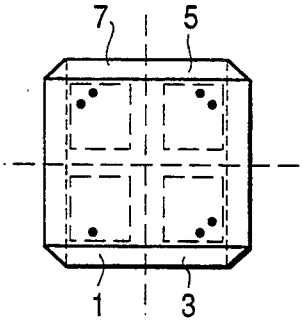
Figure 5C:
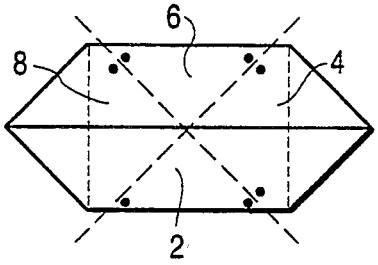

FIGS. 5*a*, 5*b* and 5*c* are top views of the three parts. FIG. 5*a* indicates the lower "half" 11 of the tetrahedron; FIG. 5*b* indicates the center disk 12; and FIG. 5*c* indicates the upper "half" 13. The edges disposed on the bottom which are not visible are drawn by a dotted line.

The three parts are divided further by means of cuts which are perpendicular with respect to their planes of intersection. All dividing cuts cross the imaginary perpendicular center axis of the tetrahedron.

The center disk 12 (FIG. 5*b*) is divided by means of two cuts into four virtually square disks, and the resulting four parts are cut out to form rings. In this case, those outer ring sides which form a portion of the tetrahedron surfaces are maintained as complete surfaces. Rings are created which have the reference number 1, 3, 5 and 7. FIG. 5*b* indicates the dividing cuts and the ring cutouts by means of the interrupted lines.

The two other tetrahedron parts 11 (FIG. 5*a*) and 13 (FIG. 5*c*) are divided by means of cuts which extend diagonally with respect to those extending through the center disk. The cuts are identical in the case of both parts. In FIGS. 5*a* and 5*c*, the cuts are indicated by interrupted lines. Of the resulting irregular polyhedrons, the parts 2, 4, 6 and 8 of the lower and upper "half" which are disposed above one another in the tetrahedron are connected with webs; three of the pairs with two webs respectively and one—the last chain link—with only one web. The webs are illustrated in FIG. 2*b* (9, 10) and FIG. 2*d*. They have the same height as the center disk of the tetrahedron. They are provided perpendicularly, extending in the same direction as the dividing cuts. Each web leads through one of the ring-shaped elements. In FIGS. 5*a* and 5*c*, the end points of the connecting webs are entered as black dots. They are in each case disposed on the rectangular planes of intersection; on the top in FIG. 5*a* and on the bottom in FIG. 5*c*. FIG. 5*b* indicates the position of these webs in the center rings when the tetrahedron puzzle is assembled.

In the case of this division of a regular tetrahedron, the thickness of the center disk 12 determines the largest possible extent of the ring cutouts. The thicker it is, the smaller the ring cutouts must be because the exterior sides of the rings disposed on the tetrahedron surface are sloped diagonally and must remain unimpaired by the ring cutouts.

The disk thickness, the thickness and shape of the webs which connect the polyhedron pairs; as well as the points at which the webs are provided on the polyhedrons must be selected such that the two polyhedron pairs, which hang jointly in a ring-shaped element, can be moved independently of one another. This means that the ring cutout must be large enough so that, in it, the ends of the two polyhedron pairs can be moved past one another and so that the ring-shaped elements can be freely rotatable in the perpendicular line in a chain which hangs down.

According to the same principle, the puzzle chain may be constructed such that it results, for example, in a cube or in a regular octahedron, etc.

Figure 6:
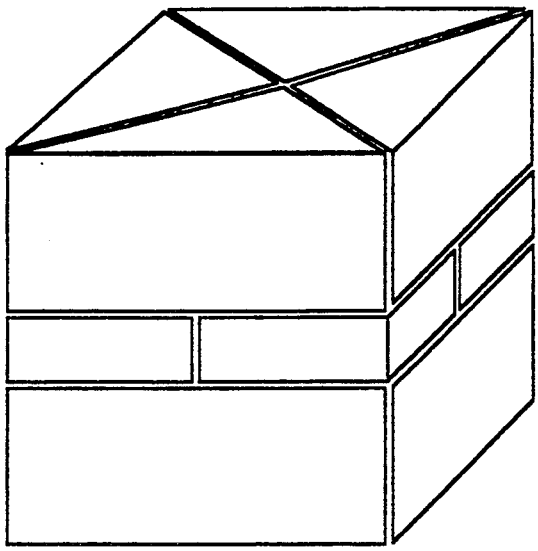
FIG. 6 is a view of an embodiment of an eight-link puzzle chain as a cube.

FIG. 6 shows an example of an assembled cubical puzzle. This division of the cube corresponds precisely to the above-described division of the regular tetrahedron. The ring-shaped chain links together form a disk which bisects the cube in parallel to two of its surfaces. The disk is divided into four square ring-shaped elements; the upper and the lower cube half is in each case divided into four segments by means of diagonal cuts. An eight-link chain is obtained.

Figure 7:
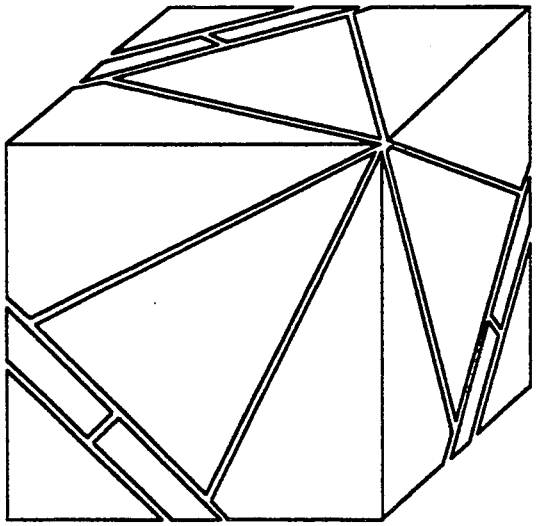
FIG. 7 is a view of another cube-shaped embodiment as a twelve-link chain.

Another variant of a cubic puzzle chain is illustrated in FIG. 7 in the assembled condition. In this case, the center ring disk extends through the center of six cube edges. This disk has a hexagonal shape and, in this example, is divided into six four-cornered ring elements. The remaining cube segments above and below the disk are also divided into six segments, specifically by means of cuts which extend in an angle-bisecting manner with respect to the cuts through the center disk. This results in a twelve-link chain.

The puzzle game may be manufactured from firm materials, such as metal, plastic, plexiglass, wood, stone or cardboard. The puzzle bodies may be solid or hollow. The visual effect of the game can be heightened by different materials, a coloring or a surface treatment of the individual elements or of their individual surfaces.

For the purpose of stabilizing their target shape, the individual chain links may be provided with magnets which are disposed on the interior surfaces in a sunk manner and hold the individual elements together. A pair of magnets 15 and 16 is illustrated as an example in FIG. 3*a*. The magnets may also be disposed on the inside of the puzzle body in an invisible manner.

A further development provides a holding device which is provided on the first element in the puzzle chain. In FIGS. 1 and 3, it is shown as a thread having a loop 14. This holding device facilitates the handling of the game. It may be constructed, for example, as a chain, a band, a ring or a thread and also as a decorative element.

The special attraction of this game is the unexpected transformation of the solid puzzle body into a movable regular link chain which is surprising. The joy in this transformation is long lasting even beyond the first surprise so that the puzzle continues to be enticing. The correct assembling method is usually not recognized immediately because the toothed movable link chain seems to have nothing in common with the solid puzzle body. This is the more so, the further the puzzle deviates from the familiar principle of the right angle.

Once the solution is found, the puzzle can re reassembled rapidly and in an uncomplicated manner so that one does not hesitate to disassemble it again.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A three-dimensional link chain puzzle including puzzle elements which together constitute chain links when in an unassembled condition and form a polyhedron when in an assembled condition, said puzzle elements comprising:

a plurality of cornered rings which form an interrupted plane disk which extends through a center of the assembled polyhedron, and a plurality of irregular polyhedron parts which are disposed above and below the plane disk formed of the rings in the assembled polyhedron.

2. A three-dimensional puzzle according to claim 1, wherein the cornered rings and polyhedron parts are configured and dimensioned so that the plane disk divides the assembled polyhedron in half.

3. A three-dimensional puzzle according to claim 1, wherein at least one outer side of each of the cornered rings forms a portion of the surface of the assembled polyhedron, other sides of said cornered rings abutting sides of other cornered rings on the interior of the polyhedron.

4. A three-dimensional puzzle according to claim 3, further comprising webs for linking the chain and cuts for dividing the polyhedron into individual link elements and the centered disk.

5. A three-dimensional puzzle according to claim 3, wherein an even number of said chain link puzzle elements are provided, one half of said chain link puzzle elements being the cornered rings, and the other half of said chain link puzzle elements consisting in each case of two segments of the polyhedron parts disposed adjacent one another above and below the rings, said polyhedron parts being connected with one another by means of two webs so they form a closed chain link with the exception of the last link which has only one web, and wherein each of these webs lead through one of the ring-shaped elements, whereby a coherent link chain is formed of alternately one of the regular polyhedron pairs and one ring-shaped element.

6. A three-dimensional puzzle according to claim 1, further comprising webs for linking the chain and cuts for dividing the polyhedron into individual link elements and the centered disk.

7. A three-dimensional puzzle according to claim 1, wherein an even number of said chain link puzzle elements are provided, one half of said chain link puzzle elements being the cornered rings, and the other half of said chain link puzzle elements consisting in each case of two segments of the polyhedron parts disposed adjacent one another above and below the rings, said polyhedron parts being connected with one another by means of two webs so they form a closed chain link with the exception of the last link which has only one web, and wherein each of these webs lead through one of the ring-shaped elements, whereby a coherent link chain is formed of alternately one of the regular polyhedron pairs and one ring-shaped element.

8. A three-dimensional puzzle according to claim 7, wherein the division of the polyhedron into individual link elements is such that the centered disk as well as the two polyhedron parts above and below this disk are each divided by cuts which are perpendicular with respect to the two planes of section of these three parts, and which all extend from a common perpendicular center axis of the polyhedron body toward the outside.

9. A three-dimensional puzzle according to claim 8, wherein the polyhedron segments above and below the centered disk are divided by the same cuts and the cuts extend through the centered disk in each case in an angle-bisecting manner.

10. A three-dimensional puzzle according to claim 1, comprising magnets for holding the puzzle elements together.

11. A three-dimensional puzzle according to claim 1, comprising a connecting device on which the puzzle can be held which is mounted on the first link of the puzzle chain.

12. A three-dimensional puzzle according to claim 11, wherein said connecting device is one of a thread, a ring and a chain.

* * * * *